US007146948B1

(12) United States Patent
Eells

(10) Patent No.: US 7,146,948 B1
(45) Date of Patent: Dec. 12, 2006

(54) VALVE LIFTING ARRANGEMENT

(76) Inventor: Clinton D Eells, 22354 Lake Rd., Saegertown, PA (US) 16433

( * ) Notice: Subject to any disclaimer, the term of this patent is extended or adjusted under 35 U.S.C. 154(b) by 0 days.

(21) Appl. No.: 11/162,995

(22) Filed: Sep. 30, 2005

(51) Int. Cl.
*F01L 1/30* (2006.01)

(52) U.S. Cl. ..... 123/90.24; 123/90.25; 123/90.26; 123/90.16

(58) Field of Classification Search ..... 123/90.25, 123/90.26, 90.24, 90.4, 90.16; 74/569
See application file for complete search history.

(56) References Cited

U.S. PATENT DOCUMENTS

| | | | | |
|---|---|---|---|---|
| 992,089 | A | 5/1911 | Watt | |
| 1,118,411 | A | 11/1914 | Granz | 74/54 |
| 1,238,175 | A | 8/1917 | Moore | 123/90.26 |
| 1,309,339 | A | 7/1919 | Reynolds | 123/90.47 |
| 1,504,774 | A | 8/1924 | Martin | |
| 1,659,528 | A | 2/1928 | Hosterman | |
| 1,684,407 | A | 9/1928 | Nibbs | 123/61 V |
| 2,047,446 | A | 7/1936 | Taylor | 123/90 |
| 2,122,484 | A | 7/1938 | Murray | 123/90.25 |
| 2,244,706 | A | 6/1941 | Irving | 123/63 |
| 2,846,988 | A | 8/1958 | Iskenderian | 123/90 |
| 2,858,818 | A | 11/1958 | Bailey | 123/90 |
| 2,865,353 | A | 12/1958 | Sampietro | 123/90 |
| 3,024,775 | A | 3/1962 | Wuest | 123/90 |
| 3,139,076 | A | 6/1964 | Flaherty | 123/90 |
| 3,301,241 | A | 1/1967 | Iskenderian | 123/90 |
| 3,335,709 | A | 8/1967 | Mikucki | 123/90 |
| 3,831,457 | A | 8/1974 | Kern | 74/569 |
| 3,886,808 | A | 6/1975 | Weber | 74/569 |
| 4,152,953 | A | 5/1979 | Headley | 74/569 |
| 4,173,954 | A | 11/1979 | Speckhart | 123/90.5 |
| 4,222,354 | A | 9/1980 | Uitvlugt | 123/90.16 |
| 4,335,685 | A | 6/1982 | Clouse | 123/90.5 |
| 4,343,268 | A | 8/1982 | Stang et al. | 123/90.4 |
| 4,427,106 | A | 1/1984 | Woodridge | 198/842 |
| 4,762,095 | A | 8/1988 | Mezger et al. | 123/90.11 |
| 4,878,463 | A | 11/1989 | Fredericksen et al. | 123/90.41 |
| 5,307,769 | A | 5/1994 | Meagher et al. | 123/90.5 |
| 5,732,670 | A * | 3/1998 | Mote, Sr. | 123/90.24 |
| 5,806,475 | A | 9/1998 | Hausknecht | 123/90.16 |

(Continued)

FOREIGN PATENT DOCUMENTS

| | | |
|---|---|---|
| CH | 108338 | 4/1924 |

(Continued)

*Primary Examiner*—Thomas Denion
*Assistant Examiner*—Zelalem Eshete
(74) *Attorney, Agent, or Firm*—Wayne L. Lovercheck

(57) ABSTRACT

A valve actuating assembly for opening and closing a valve includes a cam mounted on a camshaft and enclosed by a pair of rotary cam guides each of which includes a roller channel having an outer race for receiving opposed ends of a roller that extends transversely from the lowermost end of a valve lifter disposed between the cam guides with the lifter being mounted to a connecting rod. The lifter has a radius at the lowermost end for engagement with the cam during certain engine phases, and the connecting rod is pivotally attached to a rocker arm, and the rocker arm attached to a valve. A valve spring mounted on the stem of the valve extends and compresses coincident with the rotation of the cam guides and contact of the roller ends with the outer races of the cam guides thereby actuating the lifter to open and close the valve with positive force and wherein the point of contact for valve opening and closing transfers between the engagement of the roller ends with the outer races and the radius against the cam during the various engine phases with the valve spring holding the valve in the closed position during certain phases through the exertion of positive force.

20 Claims, 11 Drawing Sheets

U.S. PATENT DOCUMENTS

| | | | | |
|---|---|---|---|---|
| 6,415,754 | B1 | 7/2002 | Hirano et al. | 123/90.43 |
| 6,948,468 | B1 * | 9/2005 | Decuir, Jr. | 13/90.24 |

FOREIGN PATENT DOCUMENTS

| | | |
|---|---|---|
| FR | 2645903 | 4/1989 |
| GB | 434247 | 10/1934 |
| GB | 516746 | 7/1938 |
| GB | 2244092 | 5/1990 |
| IT | 484193 | 1/1952 |
| IT | 559715 | 10/1956 |
| IT | 563164 | 12/1956 |
| JP | 62-87603 | 10/1985 |
| JP | 8-296412 | 4/1995 |
| JP | 2000-145791 | 9/1999 |
| JP | 2003-222006 | 8/2003 |

* cited by examiner

VALVE LIFTING ARRANGEMENT

FIELD OF THE INVENTION

The present invention pertains to valve actuating mechanisms for internal combustion engines, and more particularly pertains to a valve actuating mechanism wherein the valve is opened and closed through positive force.

BACKGROUND OF THE INVENTION

Most automotive engines have at least two valves for each cylinder, one intake and one exhaust valve. Since each of these valves operates at different times, separate operating mechanisms must be provided for each valve. Valves are normally held closed by heavy springs and by compression in the combustion chamber. The purpose of any valve-actuating mechanism is to overcome the spring pressure and open the valves at the proper time. The valve-actuating mechanism includes the engine camshaft, the camshaft followers (valve lifters or tappets), pushrods, and rocker arms.

Among the prior art patents that disclose valve operating assemblies and mechanisms are the following: Granz U.S. Pat. No. 1,118,411; Moore U.S. Pat. No. 1,238,175; Reynolds U.S. Pat. No. 1,309,339; Nibbs U.S. Pat. No. 1,684,407; Murray U.S. Pat. No. 2,122,484; Irving U.S. Pat. No. 2,244,706; Bailey U.S. Pat. No. 2,858,818; and Folino 2004/0055552 A1.

SUMMARY OF THE INVENTION

The present invention comprehends a valve actuating assembly or mechanism for an internal combustion engine that includes a valve lifter having a roller rotatably mounted at the lower end of the lifter. A plurality of rotary cam guides are mounted on the camshaft with one pair of cam guides oppositely mounted to each valve lifter. Each cam guide includes an elliptical or oblong-shaped roller track or channel and the roller channels for each pair of cam guides are of equivalent dimensions. A cam is mounted on the camshaft between the cam guides, and the lowermost end of the lifter is defined by an arcuate undersurface or radius that is engaged by the cam during certain phases of the engine cycle. The opposed ends of the roller fit within each respective roller channel of each cam guide so that the roller is simultaneously engaged at both opposed ends by the outer surfaces of the roller channels during certain phases of the engine cycle.

The lifter is actuated through the engagement of the roller ends with the outer surfaces of the roller channels during the rotation of the cam guides on the camshaft. Moreover, the lifter is interconnected to a connecting rod, and actuation of the lifter causes a rocker arm pivotally attached at one end to the connecting rod to open and close the valve with positive force. During those phases when the valve is closed a light valve spring that is disposed immediately above—and contained between—the end of the rocker arm that interconnects to the valve extension of the valve and a retainer compresses approximately 1/16 of an inch or with a force of roughly 60 pounds for preventing the valve from inadvertently opening and to provide for expansion and contraction resulting from temperature changes. Thus, the positive force required to open and close the valve of the present invention is approximately 10 percent of that currently in use wherein approximately 200 pounds of force per valve are required for opening and closing.

It is an objective of the present invention to provide a valve actuating assembly for an automotive engine that uses a positive force to open and close the valves of the engine.

It is another objective of the present invention to provide a valve actuating assembly for an automotive engine wherein the valve spring for each valve provides for a positive closure of the cylinder port.

It is yet another objective of the present invention to provide a valve actuating assembly for an automotive engine wherein the release of the valve spring initiates the movement of the valve ahead of the rotation of the cam thereby reducing wear on the lifter.

Yet another objective of the present invention is to provide a valve actuating assembly for an automotive engine wherein the release of the pressure of the valve spring actually sets the weight of the valve assembly in motion for completing various phases of the engine cycle.

Yet still another objective of the present invention is to provide a valve actuating assembly for an automotive engine wherein the contact point continuously shifts from between the bottom radius of the lifter to the roller for initiating valve opening and closing during the various engine cycles.

These and other objects, features and advantages will become apparent to those skilled in the art upon a perusal of the following detailed description read in conjunction with the drawing figures and appended claims.

DETAILED DESCRIPTION OF THE PREFERRED EMBODIMENT

Illustrated in FIGS. 1 through 13 is a mechanical arrangement or mechanism for raising and lowering the valves of an internal combustion engine; and specifically the internal combustion engine of an automotive vehicle. The valve lifting arrangement 10 of the present invention is most suitably adapted for a four stroke cycle engine, and particularly a four stroke cycle engine of the I-head or overhead valve construction. However, it would be possible to adapt the valve lifting arrangement 10 of the present invention for the type of engine known as an F-head engine.

Figure 1:
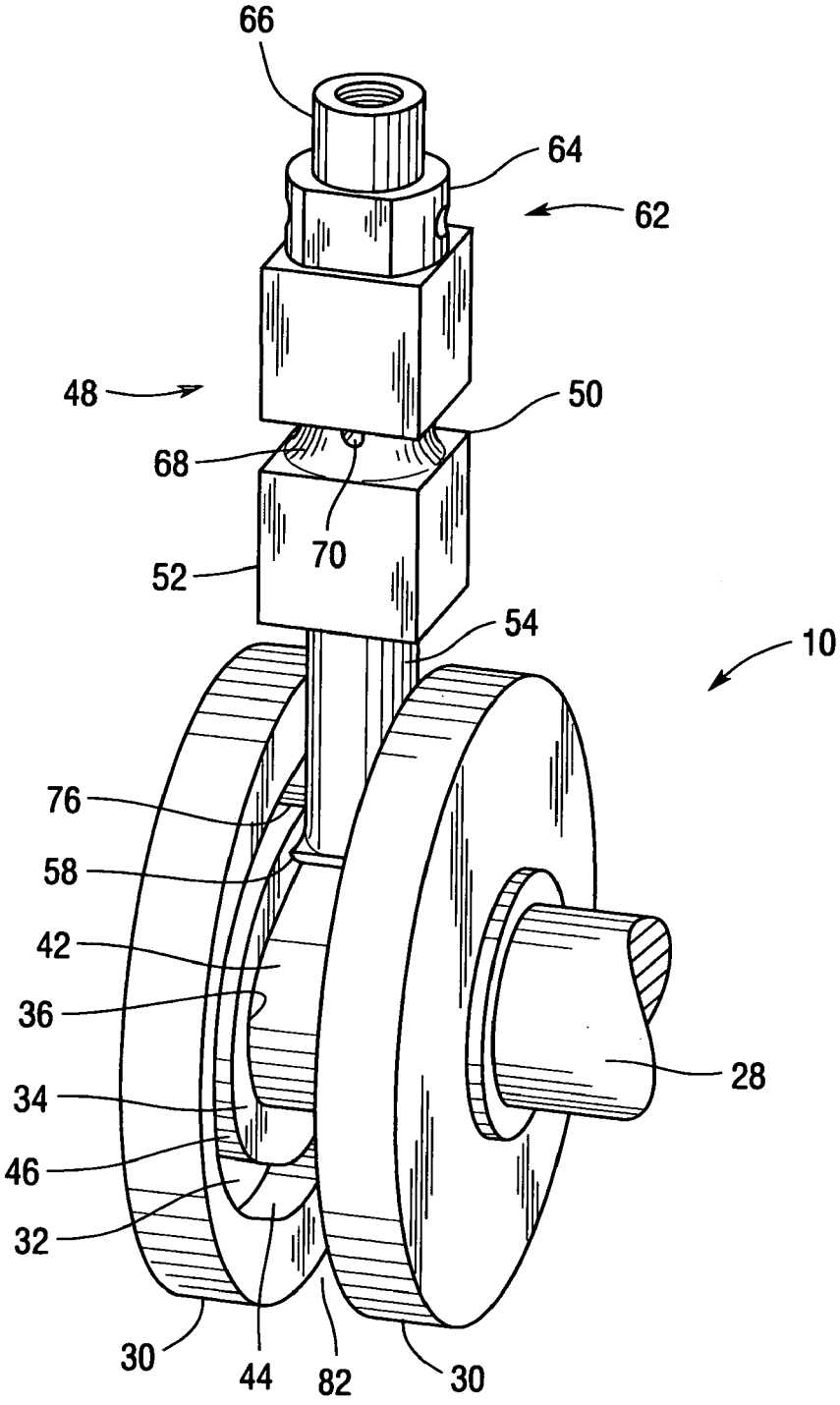
FIG. 1 is a perspective view of the valve actuating assembly of the present invention illustrating the interconnection of the lifter with the channels of the rotary cam guides.
Figure 2:
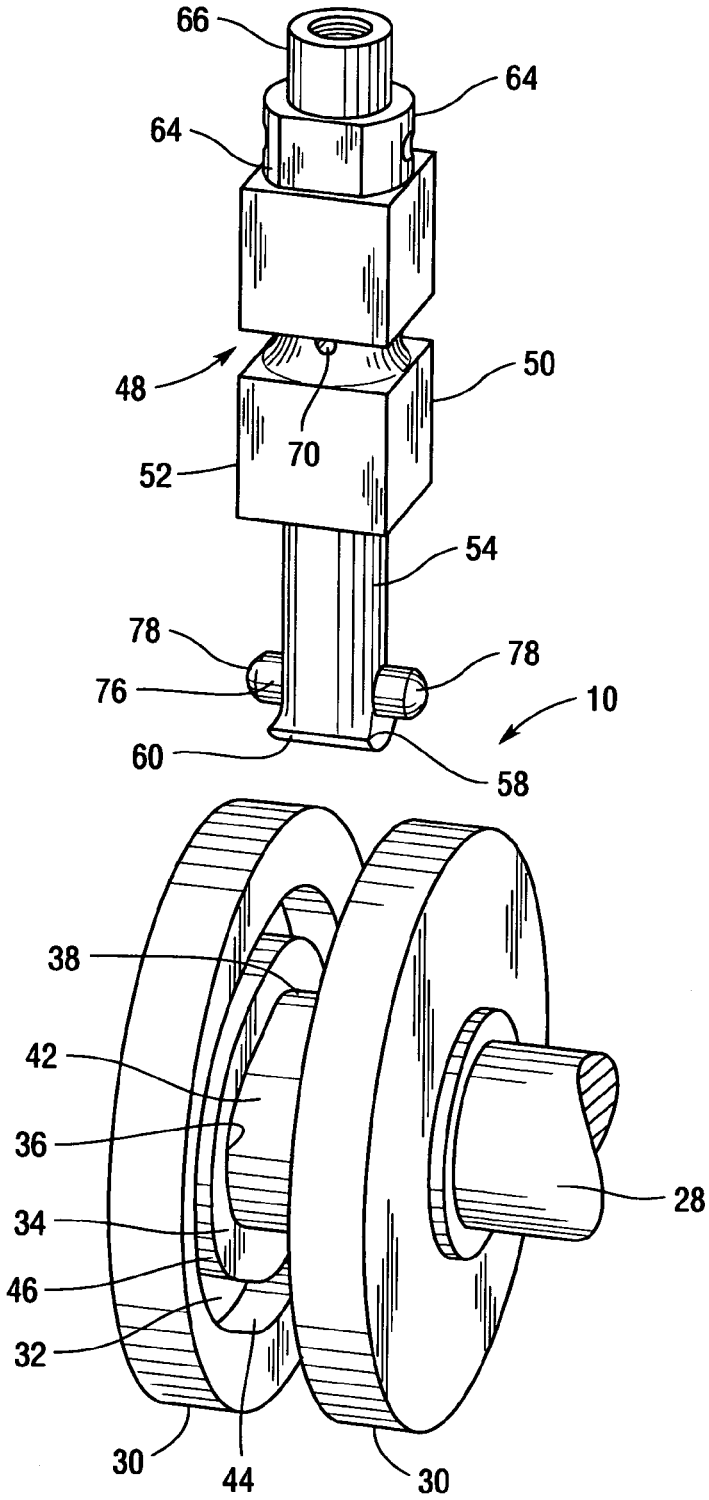
FIG. 2 is a perspective view of the valve actuating assembly of the present invention illustrating the cam guides and the radius and roller at the lower end of the lifter.
Figure 3:
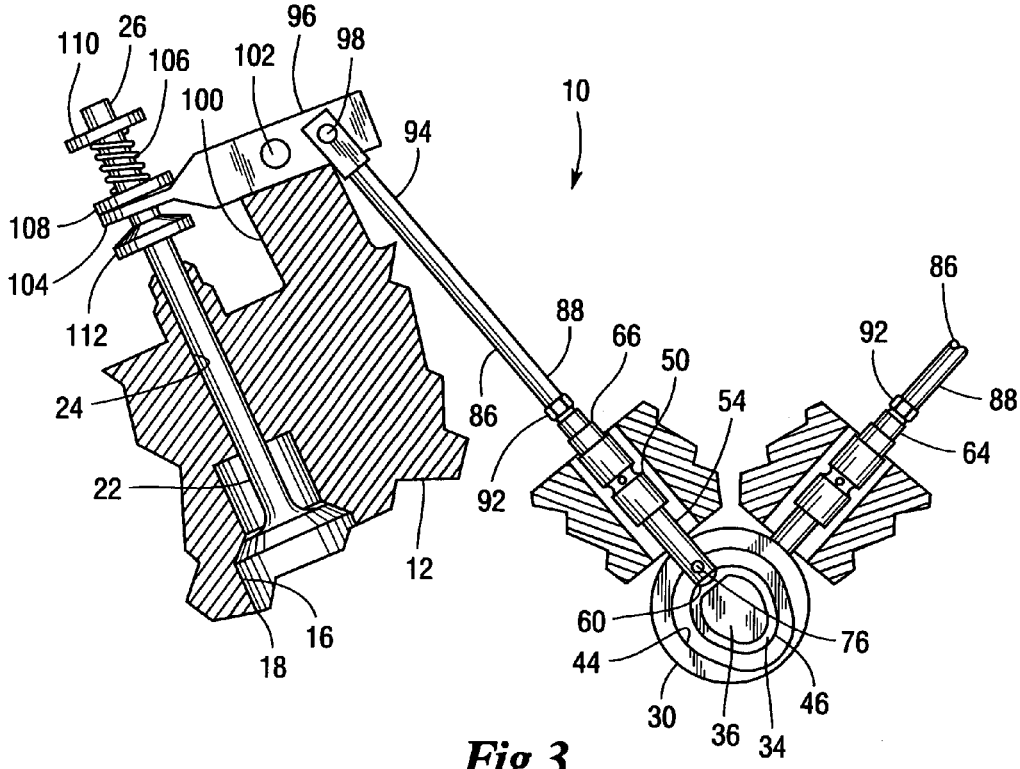
FIG. 3 is a sectioned view of the valve actuating assembly of the present invention illustrating all the primary components of the valve actuating assembly at a particular piston stroke of the engine cycle.
Figure 4:
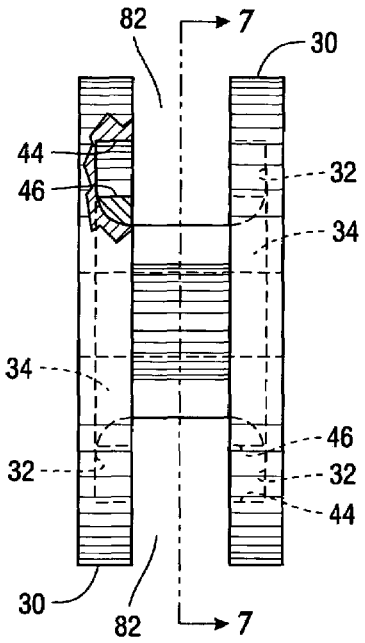
FIG. 4 is a side elevational view of the valve actuating assembly of the present invention illustrating the disposition of the cam enclosed between the rotary cam guides.
Figure 5:
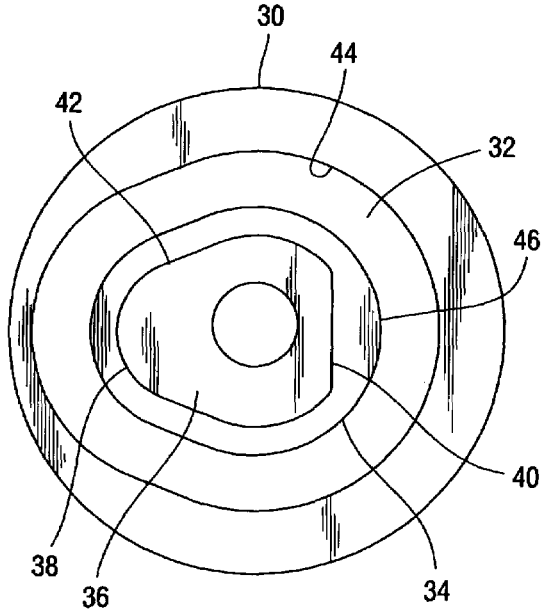
FIG. 5 is a sectioned elevational view of the valve actuating assembly of the present invention taken along lines 5–5 of FIG. 4 illustrating the disposition of the cam relative to the channel of the rotary cam guide.

FIGS. 3 and 9 through 12 illustrate for representative purposes a portion of a cylinder head 12 having a rocker arm mounting block. An upper end or head 16 of a cylinder 18 is shown, and a representative port 20 is shown in communication with cylinder 18 for allowing the ingress and egress of the air and fuel mixture and the evacuation of the exhaust gases during the various piston strokes (intake, compression, power and exhaust) that comprise the reciprocating piston movements of a four cycle engine. A representative valve 22 is shown that includes a valve stem 24 and the reciprocable movement of valve 22 results in the opening and closing of port 20 of cylinder 18 coincident with the reciprocable strokes of the piston. Valve stem 24 includes an upper valve stem extension 26 that projects slightly past cylinder head 16, and all the components of valve lifting arrangement 10 are enclosed within a standard cylinder head cover (not shown). Valve stem extension 26 provides a shoulder for a rocker arm to push against. FIGS. 1 and 2 illustrate a portion of a camshaft 28 that is enclosed within and extends through the engine block (not shown).

Illustrated in FIGS. 1 through 5 and 8 through 12 are a pair of rotary cam halves or guides 30 that are spaced or separated from each other and are mounted on camshaft 28 for coincident rotation with camshaft 28. In the preferred embodiment cam guides 30 are disc-shaped but they can also be in the shape of squares, rectangles, triangles, etc., so long as they can be mounted on camshaft 28 and accommodated within the engine block. Each cam guide 30 includes an inwardly opening roller track or channel 32, and roller channels 32 are equal in dimensions and thus mirror each other in depth and shape. The shape of each roller channel 32 is not circular, but is of an elongated oblong or elliptical shape; but in any case, the shape of each roller channel 32 should complement or mirror the other roller channel 32. However, each roller channel 32 is continuously uniform in width and depth as shown most clearly in FIGS. 4 and 5; but they cannot be circular in shape. Each rotary cam guide 30 is further defined by an interior intermediate portion 34, and each intermediate portion 34 is eccentrically mounted relative to camshaft 28 and also has an elongated shape. Mounted on camshaft 28 and in between the separation of each cam guide 30 is a cam 36 that rotates concomitant with cam guides 30 and with camshaft 28. Cam 36 also has an elliptical or elongated shape, and cam 36 is shaped similar to each adjacent intermediate portion 34 but cam 36 is smaller in size than each intermediate portion 34. Thus, cam 36 never extends beyond each intermediate portion 34 during its rotation on camshaft 28, or, alternatively, cam 36 doesn't extend into roller channels 32. Cam 36 includes a lobe 38 and an opposite flat or stepped portion 40, and the exterior of cam 36 defines a cam surface 42. In addition, each roller channel 32 includes an outer surface or race 44 and an opposite inner surface or race 46, and the separation or distance of surfaces 44 and 46 from each other defines the width of each roller channel 32. Cam guides 30, roller channels 32, and cam 36 are coaxially mounted on camshaft 28 and are timed to rotate as a unit.

Illustrated in FIGS. 1 through 3 and 6 through 8 is a valve tappet or lifter 48 for transmitting the rotational motion of camshaft 28 into reciprocating motion for raising and lowering valve 22 and thereby uncovering and covering cylinder port 20 as part of the engine piston strokes or cycles. Valve lifter 48 includes a lifter body 50 and a generally square lifter head 52. Square lifter head 52 has increased surface area for providing a longer life for lifter 48. Valve lifter 48 includes a cylindrical stem 54 that allows lifter 48 to be turned and rotated for inserting lifter 48 between cam guides 30. The lower end of stem 54 of lifter 48 includes a roller aperture 56 that transversely extends through stem 54. Lifter 48, and more specifically the lower end of stem 54, includes a square-shaped foot 58, and foot 58 includes an arcuate undersurface or radius 60 that interacts with cam 36 during certain piston strokes of the engine cycle. Lifter 48 includes an upper lifter end 62, and upper lifter end 62 includes at least one pair of opposed alignment flats 64. Upper end 62 terminates with an internally threaded cylindrical portion 66. A retaining clip is placed on alignment flats 64 to maintain the orientation of lifter 48 between cam guides 30. Lifter body 50 also includes at least one oil groove 68 that circumscribes lifter body 50 and several ports 70, at least one of which is located in communication with oil groove 68. Ports 70 register with an internal chamber 72 that extends the length of lifter body 50. Chamber 72 narrows to, and registers with, a passageway 74 that extends through stem 54 whereupon passageway 74 registers with roller aperture 56 for allowing the conveyance of oil or other lubricants through chamber 72 and passageway 74 and thence into roller aperture 56 for lubrication of a roller 76 disposed therein.

Figure 6:
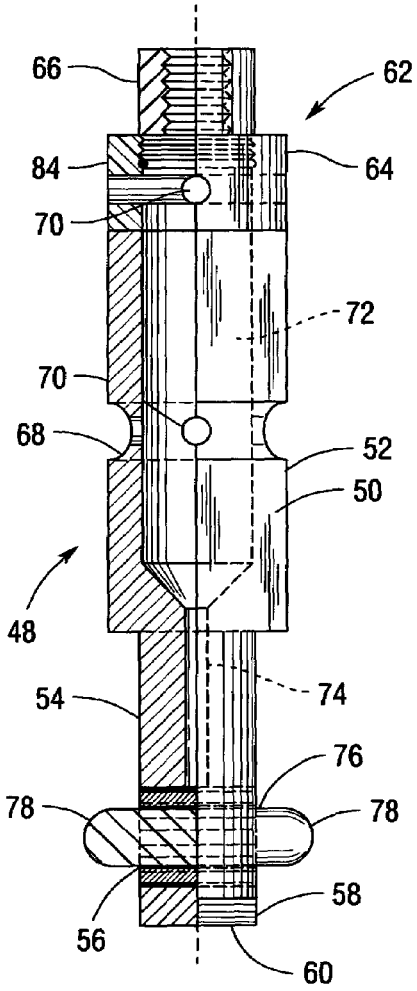
FIG. 6 is a side elevational view of the valve actuating assembly of the present invention illustrating the valve lifter and the radius and roller extending through the lower end of the lifter.
Figure 7:
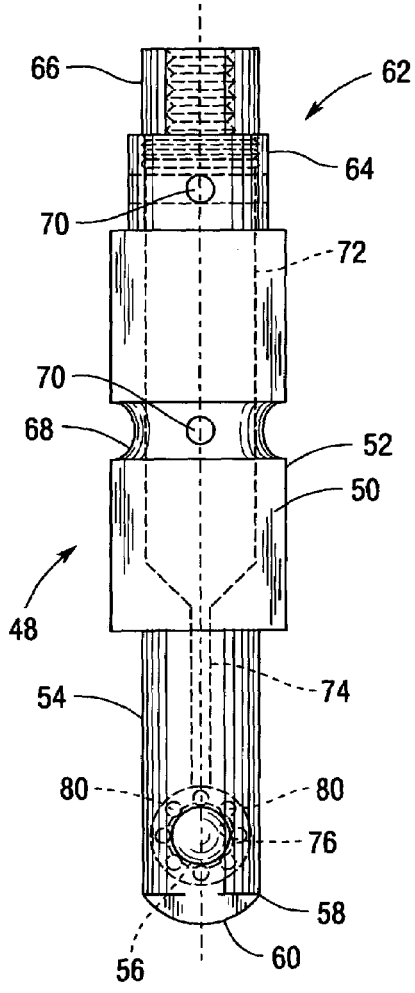
FIG. 7 is a side elevational view of the valve actuating assembly of the present invention illustrating the internal fluid chamber extending through the lifter and the bearing supports for the roller.
Figure 8:
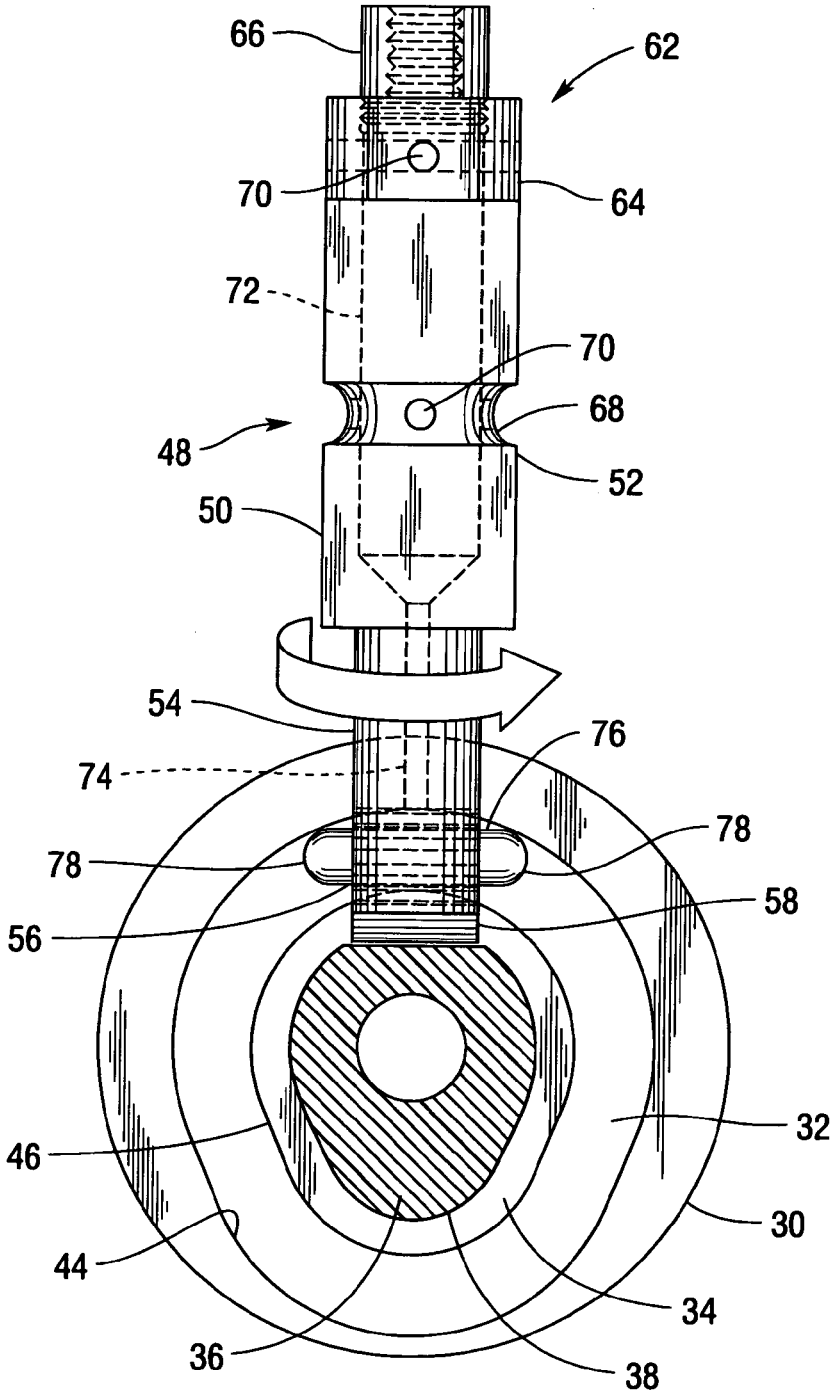
FIG. 8 is a side elevational view of the valve actuating assembly of the present invention illustrating the seating of the rollers within the channel of one rotary cam guide.

As shown in FIGS. 6 through 8, roller 76 is inserted through roller aperture 56 with projecting ends 78 of roller 76 being received and contained within each roller channel 32. The insertion of ends 78 of roller 76 into each roller channel 32 of each cam guide 30 allows roller 76 to roll easier as a generally equal amount of drag is distributed on both sides of lifter 48 adjacent foot 58 of stem 54. The disposition of roller ends 78 within roller channels 32 also tends to orient lifter 48 between cam guides 30 without the need to use the lifter retainer clip. Roller ends 78 travel within channels 32 continuously throughout the rotation of rotary cam guides 30 on camshaft 28. Disposed within the lower end of stem 54 of lifter 48 and circumjacent roller 76 is a plurality of needle bearings 80. Needle bearings 80 extend transversely through stem 54 and provide a bearing surface for roller 76 to facilitate the rotation of roller 76 during the various piston strokes. Needle bearings 80 are enclosed within an inner shell or housing that is outboard and circumjacent roller 76 and roller aperture 56. Valve lifter 48 must be rotated 90 degrees to fit through the slot or gap 82 formed between cam guides 82, and then rotated 90 degrees again to insert roller ends 78 into the respective roller channels 32, as shown in FIGS. 6 through 8, so that roller ends 78 can seat within and selectively engage outer surfaces 44 of roller channels 32 of cam guides 30. After insertion of roller ends 78 in roller channels 32, the retaining clip is placed over flats 64 at upper end 62 of lifter 48. One or more O-rings 84 can be used for an oil seal as shown in FIG. 6.

As shown in FIGS. 1 through 12, a connecting or push rod 86, preferably composed of carbon steel, is attached to upper end 62 of valve lifter 48. Lower end 88 of connecting rod 86 includes external threads 90 that engage the internal threads of cylindrical portion 66 thereby allowing for the selective linear adjustment of connecting rod 86. Varying the length of connecting rod 86 allows for variation in the amount or length of travel of valve 22 and thus allows for the variation in the time required for covering and uncovering port 20. At least one lock nut 92 is used to secure connecting rod 86 in position with respect to upper end 62 of lifter 48. Upper end 94 of connecting rod 86 (which may be threaded) attaches to a rocker arm 96 at a swivel joint. More specifically, the swivel joint includes hardened swivel joint pin 98 that extends through upper end 94 of connecting rod 86 and rocker arm 96 for making the pivotal connection therewith. Rocker arm 96 can be pivotally mounted to a rocker arm shaft bracket; or, as shown in the present invention rocker arm 96 is pivotally mounted to a rocker arm mounting block 100 by a hardened rocker arm pivot pin 102. Rocker arm 96 transfers motion from connecting rod 86 to valve 22. Rocker arm 96 includes a thinner tapered end 104 that is machined to accept or be attached to valve stem extension 26. Tapered end 104 of rocker arm 96 moves with valve stem extension 26 during the piston strokes that comprise the four cycle engine. In addition, it should be noted that the distance between or from swivel joint pin 98 to rocker arm pivot pin 102 is closer or less than the distance between rocker arm pivot pin 102 and the point where tapered end 104 of rocker arm 96 connects or attaches to valve stem extension 26. This provides for a more precise timing in the opening and closing of port 20.

As illustrated in FIGS. 9 through 12, valve stem extension 26 includes a medium duty valve spring 106 rated at approximately 60 pounds of force at 1/16 of an inch travel between the spring relaxed state and the spring compressed state or, in known in the alternative as the valve compression state. Valve spring 106 is contained between a lower retainer 108 and an upper retainer 110, and valve spring 106 provides for a positive closure of port 22 as will be hereinafter further described. In addition, the release of valve spring 106 during certain parts of the piston stroke actually transmits motion to rocker arm 96 and lifter 48 for generating valve 22 movements. Lower retainer 108 is pushed upward during certain parts of the piston stroke. Moreover, valve spring 106 only holds valve 22 in place in the closed position; valve spring 106 doesn't actually pull on valve 22 and thus only positive force is exerted on valve 22 by spring 106 during certain piston strokes. Disposed on valve stem extension 26 below lower retainer 108 is a belled spring washer or cupped washer 112 that acts as a wearing surface. Cupped washer 112 softens impact and absorbs shock from the continuous direction change of rocker arm 96 relative to valve stem extension 26. A second lower retainer can be placed on valve stem extension 26 immediately below cupped washer 112 to further support and maintain the position of cupped washer 112 on valve stem extension 26. Cupped washer 112 and lower retainer 108 move with valve stem extension 26 coincident with the movement of rocker arm 96 and valve 22 for covering and uncovering port 20 during the respective piston strokes. All of the aforementioned components can also be referred to as the valve assembly or valve actuating mechanism.

Figure 9:
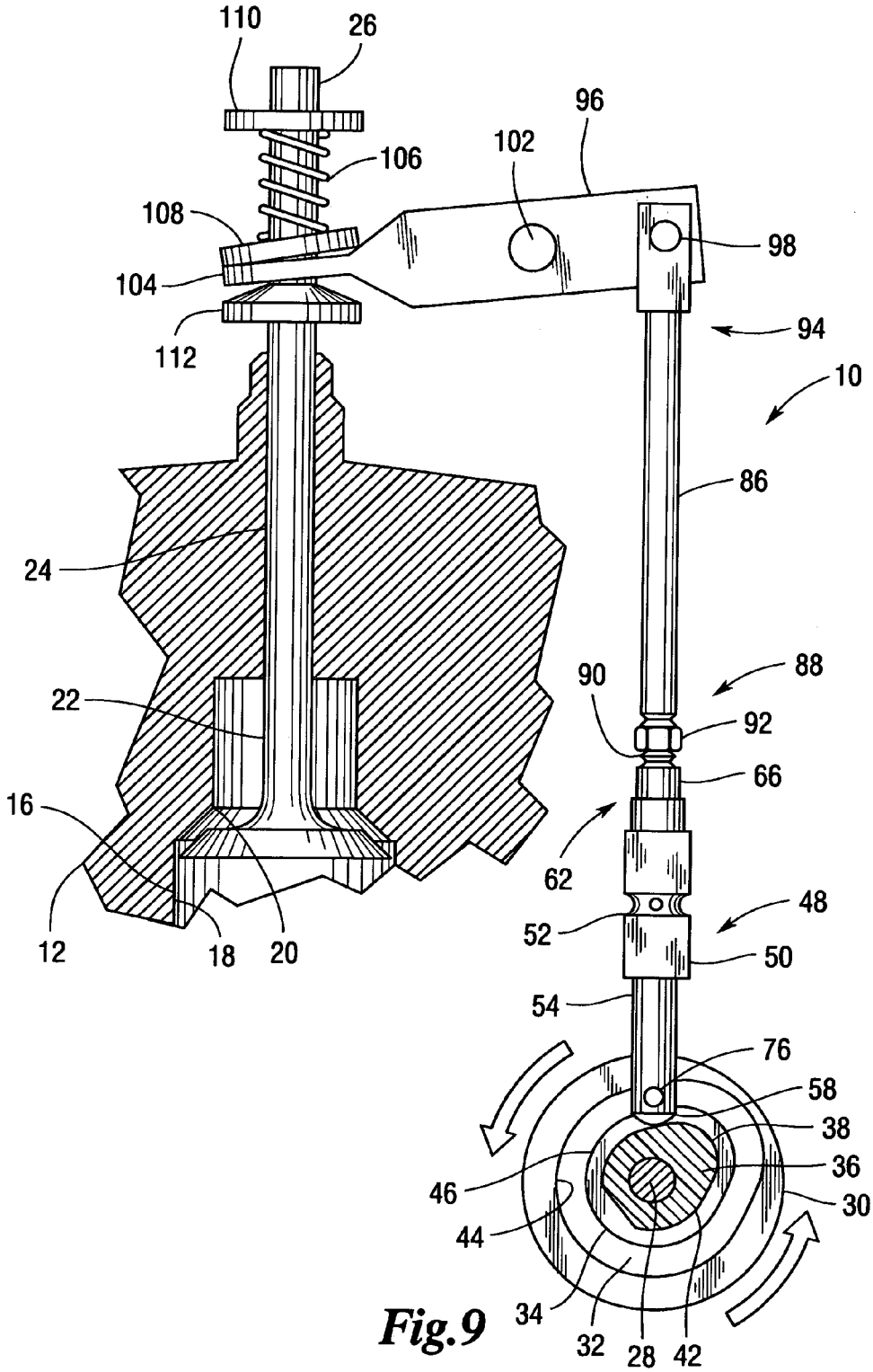
FIG. 9 is a side elevational view of the valve actuating assembly of the present invention illustrating the valve actuating assembly in the climbing disposition for actuating the valve to open the port.
Figure 10:
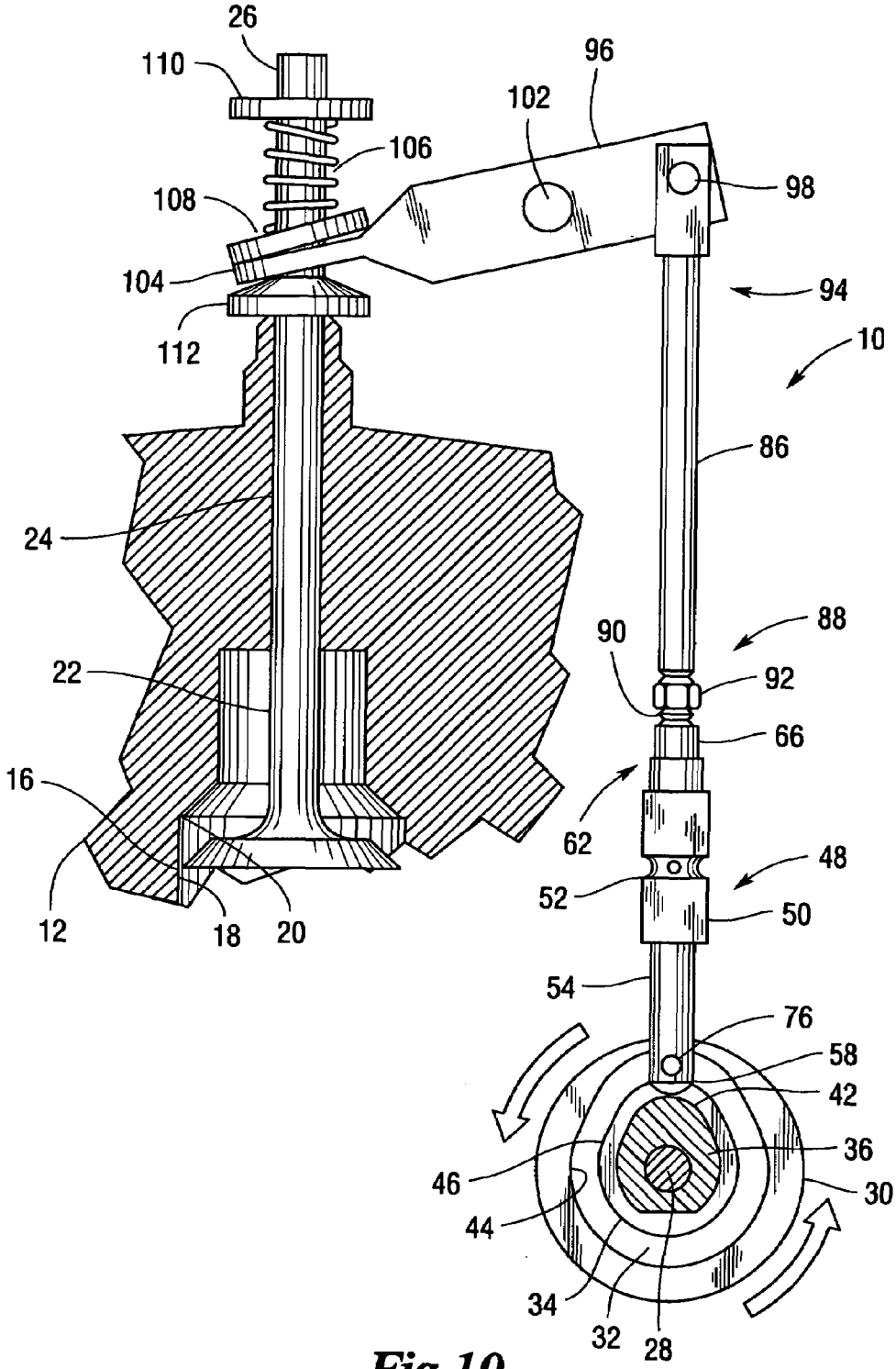
FIG. 10 is a side elevational view of the valve actuating assembly of the present invention illustrating the valve assembly in the peaked position whereupon the valve has fully opened the port.
Figure 11:
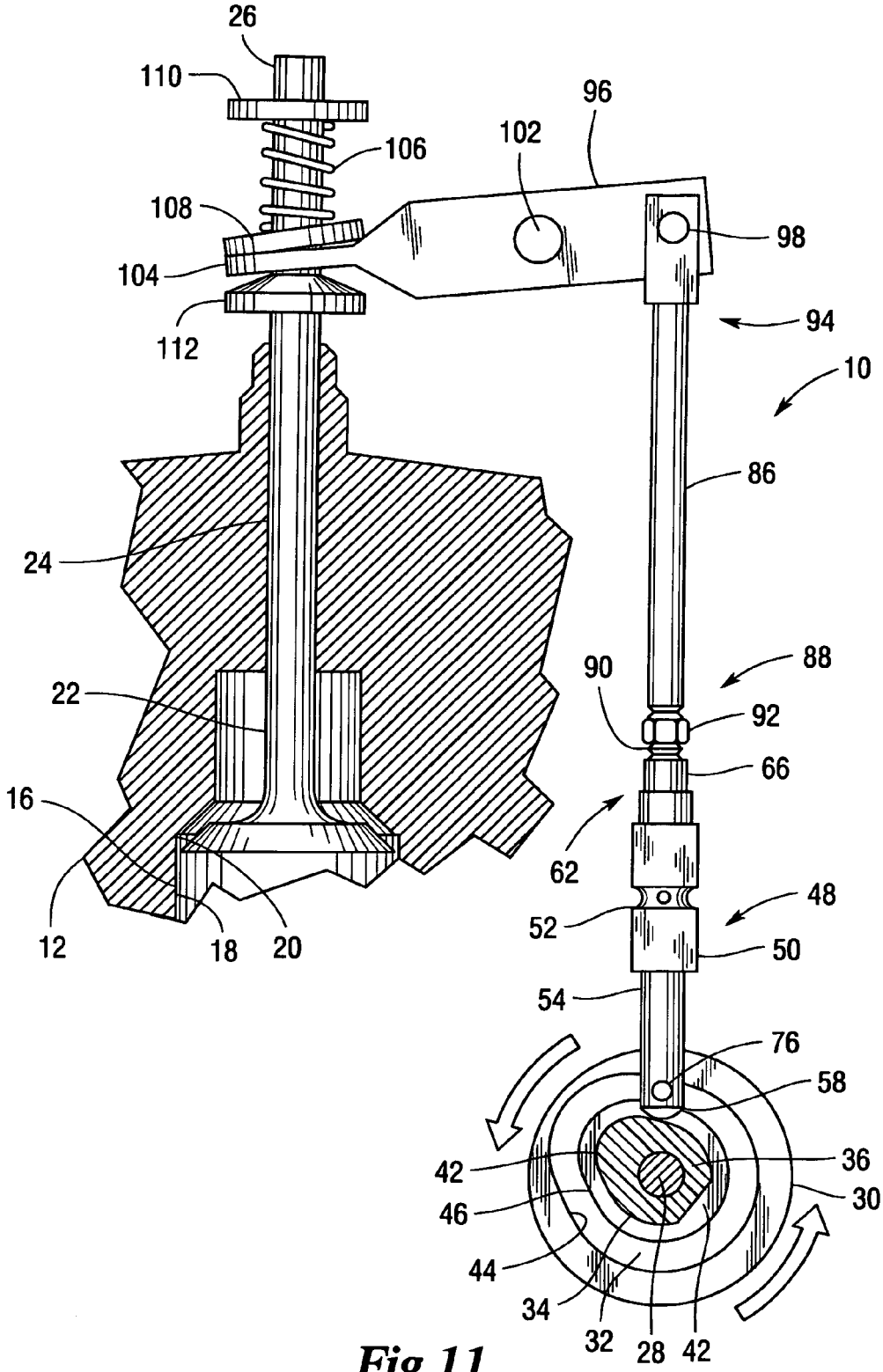
FIG. 11 is a side elevational view of the valve actuating assembly of the present invention illustrating the valve assembly in the descending position for actuating the valve to close the port.
Figure 12:
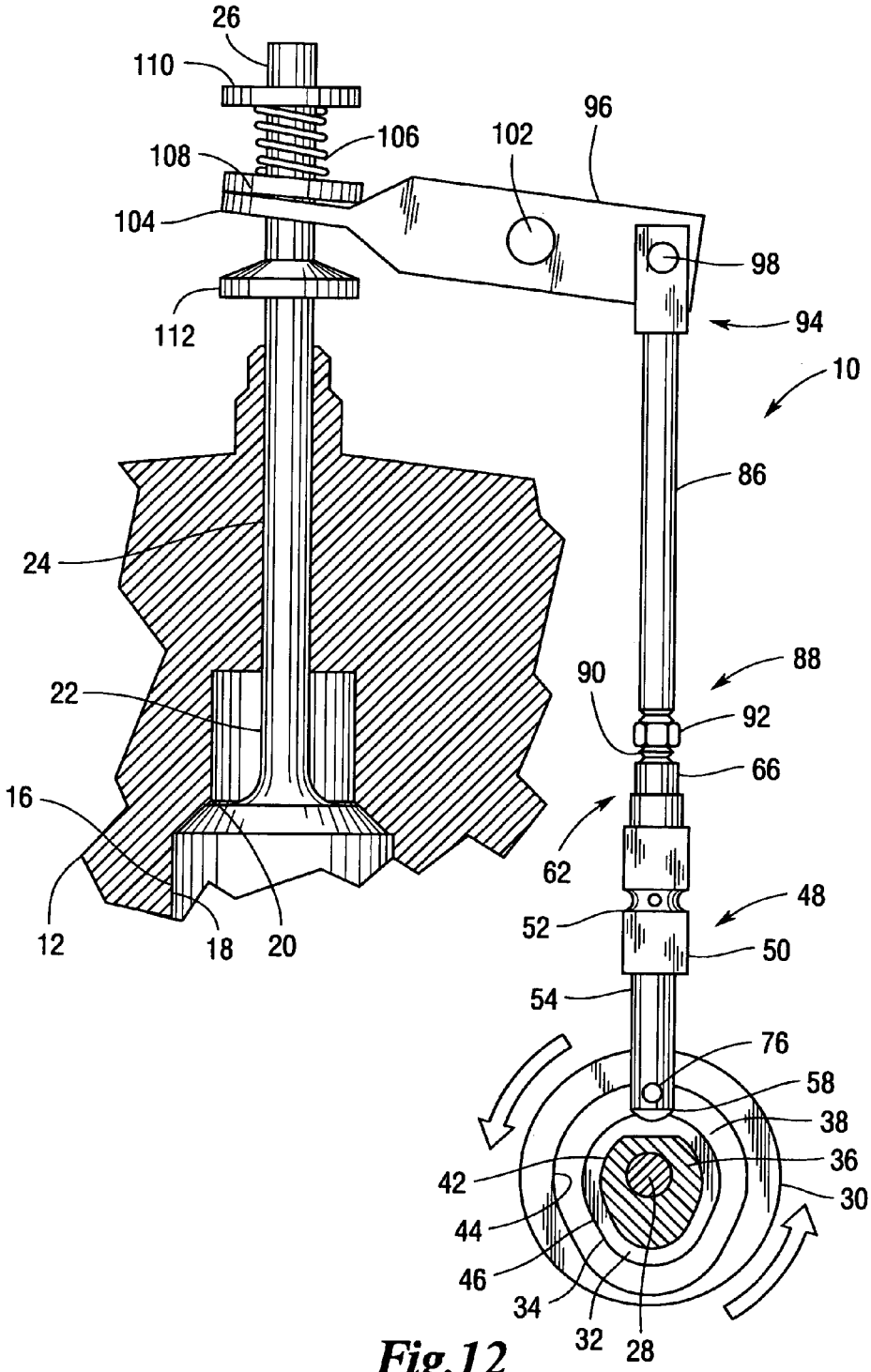
FIG. 12 is a side elevational view of the valve actuating assembly of the present invention illustrating the valve assembly in the fully descended position whereupon the valve has completely closed the port; and, FIG. 13 is a sectioned elevational view of the valve actuating assembly of the present illustrating the degrees of rotation of the cam guides and cam during the various engine phases.

The raising and lowering of valve 22 to open and close port 20 coincident with the various piston strokes is a result of the interaction of radius 60 of lifter 48 with cam surface 42 of cam 36 and the engagement of roller ends 78 of roller 76 with outer surface 44 of roller channel 32. Depending on the particular piston stroke, one or the other of the above interactions and engagements is occurring for initiating the opening or closing of port 22. In other words, mechanical contact is continuously transferred between roller ends 78 with outer surfaces 44 of channels 32, and radius 60 of lifter 48 with cam surface 42, throughout the rotation of camshaft 28 and corresponding piston strokes. However, it doesn't occur for any piston stroke that positive force is exerted by both the engagement of roller ends 78 with outer surfaces 44, and by the contact of radius 60 with cam surface 42 of cam 36. With reference to FIGS. 9 through 12, the movements can be described relative to the reciprocable upward or downward movement of lifter 48 and connecting rod 86 so that FIG. 9 illustrates lifter 48 and connecting rod 86 in the climbing disposition or state, FIG. 10 illustrates lifter 48 and connecting rod 86 in the fully extended or peaked state, FIG. 11 illustrates connecting rod 86 and lifter 48 in the descending state, and FIG. 12 illustrates connecting rod 86 and lifter 48 in the fully descended state. The directional arrows in FIGS. 9 through 12 indicate the rotational direction of camshaft 28, cam guides 30, roller channels 32, and cam 36.

Thus, FIG. 9 shows the valve assembly just prior to and commencing the opening of port 20. The pressure of valve spring 106 is released and there is no load on roller 76 or radius 60 of lifter 48 although cam surface 42 is in contact—momentarily—with radius 60 of lifter 48. It should be noted that the release of valve spring 106 pressure actually sets the weight of valve 22 in motion. As camshaft 28 rotates from the position shown in FIG. 9 to the position shown in FIG. 10, the engagement of cam surface 42 with radius 60 transmits upward movement to lifter 48 and connecting rod 86 thereby initiating the pushing open of valve 22. However, no valve spring 106 pressure is being exerted, and the only load is the weight of the entire valve assembly. In addition, there is a very slight clearance between roller ends 78 and outer surfaces 44 of both roller channels 32. Simultaneous with camshaft 28 rotation connecting rod 86 attains the peaked state causing valve 22 to move to the fully open state. There is no valve spring 106 pressure being exerted in valve 22 full open state nor is any valve weight or load being exerted. However, the contact point is shifting from the interaction between cam surface 42 and radius 60 of lifter 48 to the engagement of roller ends 78 with outer surfaces 44 of the roller channels. These contact points only shift approximately 0.003 to 0.006 of an inch. FIG. 10 illustrates maximum valve 22 opening, and in this position there is no load on the valve assembly, no valve spring 106 is being exerted, and no valve 22 weight on the assembly. Roller ends 76 are not in contact with outer surfaces 44 of roller channels 32.

As camshaft 28 rotates from the peaked position of FIG. 10, wherein valve 22 is fully open, to the descending position of FIG. 11 for initiating valve 22 closure of port 20, a number of mechanical actions simultaneously occur that raise valve 22 and close port 20. The contact point shifts from between radius 60 and lifter 48 to roller 76 through the rotation and contact of outer surfaces 44 with roller ends 78 of roller 76. Momentarily there is still no valve spring 106 pressure as the rotational contact of outer surfaces 44 with roller 76 starts to pull downward on lifter 48 and connecting rod 86. As this action occurs a clearance gap results between cam surface 42 and radius 60 of lifter 48. The clearance gap can be between 0.003 and 0.006 inches. As camshaft 28 continues its rotation from the position shown in FIG. 10 to that of FIG. 11, outer surfaces 44 of roller channels 32 continue to engage roller ends 76 and pull roller 76 downward—and thus pull downward lifter 48 and connecting rod 86. Thus, as cam guides 30 rotate to the descending position of FIG. 11, outer surfaces 44 continue to pull down on roller ends 76 coincident with the rotation of roller channels 32 thereby continuing to pull downward on lifter 48 and connecting rod 86. Throughout these actions rocker arm 96 is pivoting and this results in upper retainer 110 starting to compress valve spring 106. As camshaft 28 continues its rotation from the position of FIG. 11 to the position shown in FIG. 12, the mechanical interaction between roller ends 76 and outer surfaces 44 of roller channels 32 is transmitted through lifter 48, connecting rod 86, and rocker arm 96 thereby for raising valve 22 and seating valve 22 against port 20 so that port 20 is closed. Roller ends 78 have maintained contact with outer surfaces 44 of roller channels 32 and the interaction of roller ends 76 with outer surfaces 44 of roller channels 32 has, in effect, pulled valve 22 shut. In addition, the clearance gap of between approximately 0.003–0.006 is maintained between radius 60 of lifter 48 and cam surface 42. There is no valve spring pressure 106 being exerted, only the weight of the valve assembly. Valve 22 can be fully seated under approximately 60 to 80 pounds of load by the use of a 1/32 of an inch to a 1/16 of an inch compression of valve spring 106. It should be noted that at no time during the various piston strokes is positive force applied to either close or open valve 22 through both the combined and simultaneous mechanical interactions of roller 76 interacting with outer surfaces 44 and radius 60 of lifter 48 contacting cam surface 42. This feature allows the use of medium duty spring 106 having approximately 60 pounds of force instead of a standard heavy-duty spring having approximately 200 pounds of force. When valve 22 is raised to close port 20, roller 76 is under load through the engagement with outer races 44 of cam guides 30; when valve 22 is lowered to open port 20, roller 76 is not under load as roller 76 has disengaged from contact with outer races 44 of cam guides 30.

Figure 13:
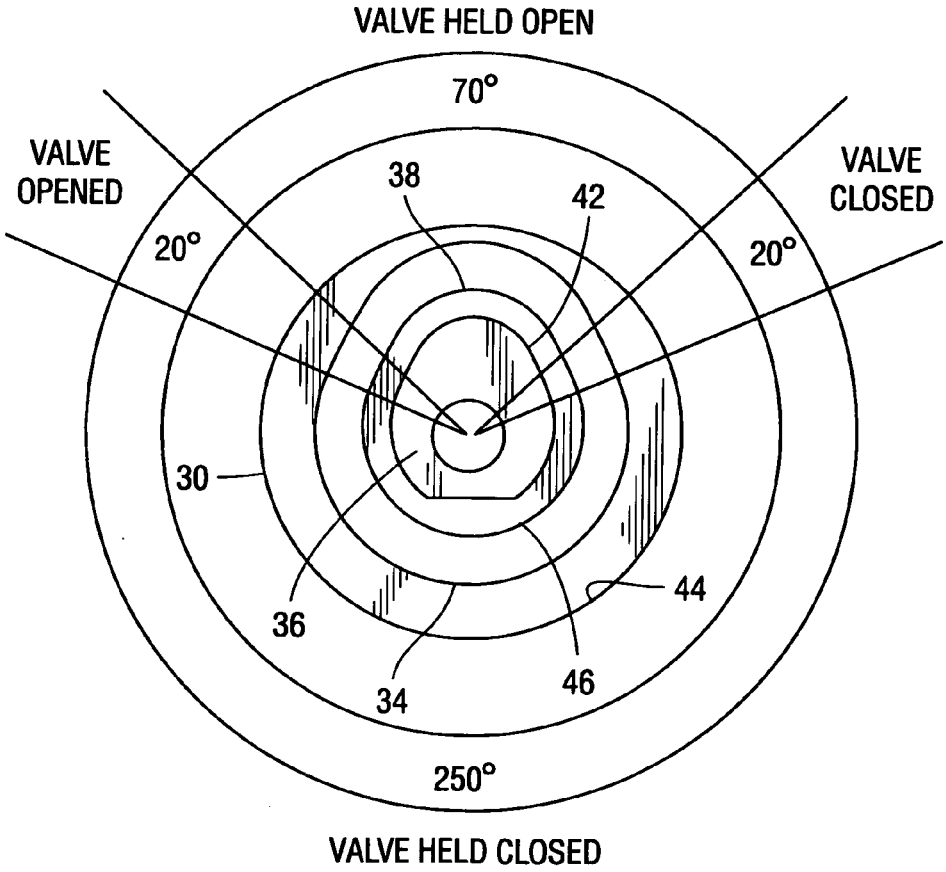

FIGS. 9 through 12 illustrate one complete cycle of the engine, and the next cycle begins with the rotation of camshaft 28 to reach the climbing position as shown in FIG. 9. During one complete engine cycle, contact is thus transferred between roller ends 78 of roller 76 and radius 60 of lifter 48. The degrees of rotation of rotary cam guides 30 and cam 36 for each piston stroke position are shown in FIG. 13. Valve 22 is held closed throughout an approximately 250 degree rotation of cam guides 30, roller channels 32, and cam 36; valve 22 is being closed throughout a rotation of approximately 20 degrees of rotation of the aforesaid components; valve 22 is held open throughout an approximately 70 degree rotation of the aforesaid components; and valve 22 is being opened throughout an approximately 20 degree rotation of the aforesaid components.

To recapitulate the various mechanical interactions that occurs during the piston strokes, in the first phase valve 22 is opened by the engagement of roller ends 78 with outer surfaces 44 of channels 32 of the opposed cam guides 30 concomitant with the rotation of camshaft 28, and then by radius 60 of lifter 48 being engaged by cam 36. The duration of this movement is approximately 20 degrees of rotation of camshaft 28 and cam guides 30. This corresponds to the climbing disposition shown in FIG. 9.

In the second phase of the engine or valve cycle, valve 22 is held open by radius 60 of lifter 48 being in contact with the elongated portion of cam 36. The duration of this movement is approximately 70 degrees of rotation of camshaft 28 and cam guides 30. This phase corresponds to the peaked disposition shown in FIG. 10.

In the third phase of the engine or valve cycle, valve 22 is closing by the rotational engagement of outer surfaces 44 of both channels 32 of both cam guides 30 with roller ends 78 pulling lifter 48 and connecting rod 86 downward concomitant with the rotation of camshaft 28. The duration for this phase is approximately 20 degrees of rotation of camshaft 28 and cam guides 30, and this phase corresponds to the descending disposition shown in FIG. 11.

Finally, valve 22 is disposed to the fully closed position through the continued engagement of roller ends 78 with outer surfaces 44 of both channels 32 of cam guides 30 concomitant with the continued rotation of camshaft 28. The duration for this phase is for approximately 250 degrees of rotation of camshaft 28 and cam guides 30, and corresponds to the fully descended position shown in FIG. 12.

While this invention has been described in conjunction with a preferred embodiment, it will be obvious to those skilled in the art that numerous modifications, alterations, and variations may be made without departing from the spirit of the invention and the scope of the claims appended thereto.

What is claimed is:

1. A valve actuating assembly interconnected to a cam mounted on a camshaft for raising and lowering a valve to close and open a port of a cylinder during the cycles of an internal combustion engine, comprising:

a plurality of rotary cam guides mounted on the camshaft of the internal combustion engine with the rotary cam guides arranged in pairs along the camshaft and each cam guide having an inwardly disposed roller channel defining an outer surface with the roller channels of each cam guide facing each other;

a reciprocating lifter interconnected to the valve and having a lower end that extends between the cam guides;

a radius located at the lower end of the lifter for selective contact with the cam during the engine cycles;

a rotatable roller mounted at the lower end of the lifter and having opposed roller ends that are received within the respective roller channels for selective interaction with the outer surfaces during certain engine cycles;

a connecting rod having a lower connecting rod end adjustably securable to the lifter and an opposite upper connecting rod end;

a rocker arm pivotally connected to the upper end of the connecting rod and having a tapered end;

the valve having a valve stem extension interconnected to the tapered end of the rocking arm;

a medium duty valve spring mounted on the valve stem extension and extensible and compressible thereon concomitant with the reciprocation of the lifter and the pivotal motion of the rocking arm during the engine cycles for raising and lowering the valve to open and close the port; and whereupon the rotation of the camshaft causes the cam to contact the radius and the roller ends to contact the outer races of the roller channels during the engine cycles thereby causing the reciprocating motion of the lifter to be transferred through the connecting to the rocker arm so that the valve can be opened and closed with positive force applied by the valve spring and the contact between the cam and the radius and the roller ends and the outer races shifting between each other so that the valve is opened, and then held opened, closed and held closed concomitant with the engine going through the various engine cycles.

2. The valve actuating assembly of claim 1 wherein the roller channels are elliptical-shaped so that contact between the roller ends and the outer races can shift from the roller contacting the outer races and being under load for closing the valve and the roller disengaging from contact with the outer races so that the roller is not under load resulting in the opening of the valve.

3. The valve actuating assembly of claim 2 wherein the point of contact between the ends of the roller and the outer races and the radius of the lifter and the cam shifts between approximately 0.003 and 0.006 inches as the valve is opened and closed during the engine cycles.

4. The valve actuating assembly of claim 3 wherein the valve spring is rated as medium duty and capable of applying approximately 60 to 80 pounds of force.

5. The valve actuating assembly of claim 4 wherein the compression of the valve spring is approximately 1/32 to 1/16 of an inch concomitant with the roller being under load through contact with the outer races of the cam guides resulting in the valve being disposed to the closed position for closing the port.

6. The valve actuating assembly of claim 5 further comprising a cupped washer mounted on the valve stem extension and beneath the tapered end of the rocker arm providing a wearing surface and acting as a shock absorbing for the tapered end of the rocker arm.

7. The valve actuating assembly of claim 6 wherein the rocker arm is pivotally secured to a rocker arm mounting block by a rocker arm pivot pin.

8. The valve actuating assembly of claim 7 wherein the distance between the connection of the upper connecting rod to the rocker arm and the rocker arm pivot pin is less than the distance between the rocker arm pivot pin and the connection of the tapered end of the rocker arm to the valve stem extension.

9. A valve actuating mechanism for opening and closing with positive force a valve of a cylinder during the cycles of an internal combustion engine that includes a cam and a camshaft, comprising:

a pair of rotary cam guides mounted on the camshaft for rotation therewith;

the cam guides spaced from each other on the camshaft and having an inner elliptical roller channel further defined by an inner race and an outer race, with the roller channels of the cam guides facing each other;

a reciprocating lifter having a lower end disposed between the cam guides;

a radius located at the lower end of the lifter for selectively contacting the cam during certain phases of the engine cycle;

a roller rotatably mounted at the lower end of the lifter and having opposed roller ends each of which is contained with one roller channel so that the roller can be held under load and released therefrom for closing and opening the valve and closing and opening the port;

a connecting rod adjustably securable to the lifter and having an upper connecting rod end;

a rocker arm pivotally attached to the upper end of the connecting rod, and having an opposite tapered end;

the valve interconnected to the tapered end of the rocker arm so that the connecting rod can transfer the reciprocating motion of the lifter to the rocker arm for actuating valve opening and valve closing during the various cycles of the engine;

a medium duty valve spring mounted on the valve for compression and extension thereon during the cycles of the engine with the valve spring compressed approximately 1/32 to 1/16 of an inch for closing the valve;

a belled spring washer mounted on the valve immediately below the connection of the tapered end of the rocker arm with the valve for absorbing the impact of the movement of the tapered end of the rocker arm with respect to the valve; and whereupon rotation of the camshaft brings the ends of the roller in contact with the outer races of the cam guides and the radius contacting the cam for opening the valve and maintaining the open position of the valve by continued contact of the radius with the cam followed by the closing of the valve as the ends of the roller maintain contact with the outer races and the valve held in the fully closed position by the continued engagement of the ends of the roller with the outer races concomitant with the compression of the valve spring for fully seating the valve under 60 to 80 pounds of load.

10. The valve actuating assembly of claim 9 wherein the cam and the cam guides rotate through approximately 20 degrees during the phase when the valve is being opened.

11. The valve actuating assembly of claim 10 wherein the cam and the cam guides rotate through approximately 70 degrees during the phase for holding the valve open.

12. The valve actuating assembly of claim 11 wherein the cam and the cam guides rotate through approximately 20 degrees during the phase when the valve is closing.

13. The valve actuating assembly of claim 12 wherein the cam and the cam guides rotate through approximately 250 of rotation during the phase for holding the valve closed.

14. The valve actuating assembly of claim 13 wherein the point of contact between the ends of the roller and the outer races and the radius of the lifter and the cam shifts between approximately 0.003 and 0.006 inches as the engine cycles for closing and opening the valve.

15. The valve actuating assembly of claim 14 further comprising a rocker arm mounting block having a rocker arm pivot pin with the rocker arm pivotally secured to the rocker arm mounting block by the rocker arm pivot pin.

16. The valve actuating assembly of claim 15 wherein the distance between the connection of the upper connecting rod to the rocker arm and the rocker arm pivot pin is less than the distance between the rocker arm pivot pin and the connection of the tapered end of the rocker arm to the valve thereby facilitating the positive opening and closing of the valve.

17. In a valve actuating apparatus of the type in which a cam is rotated to move a lifter for opening and closing with positive force a valve of a cylinder during a cycle of an internal combustion engine, the improvement comprising:

a cam and a lifter;

said lifter having a first cam engaging means to engage a first lifter means to move said lifter in a first direction with positive force through a first portion of said cycle;

said cam having a second cam engaging means to engage a second lifter means to move said lifter in a second direction with positive force through a second portion of said cycle.

18. The apparatus recited in claim 17 wherein said first portion of said cycle has a moving part and a holding part whereby said lifter is moved and held with positive force during said first portion of said cycle.

19. The apparatus recited in claim 17 wherein said second portion of said cycle has a moving part and a holding part whereby said lifter is moved and held with positive force during said second portion of said cycle.

20. The apparatus recited in claim 17 wherein said first cam engaging means comprises channels in facing surfaces of spaced parallel rotary cam guides;

said first lifter engaging means comprises a roller supported in said lifter and extending into said channels;

said second cam engaging means comprises a cam surface fixed between said spaced rotary cam guides; and, said second lifter engaging means comprises a foot end of said lifter.

* * * * *